United States Patent [19]

Klenk

[11] 4,175,740

[45] Nov. 27, 1979

[54] FOLDING MACHINE

[75] Inventor: Emil Klenk, Murrhardt, Fed. Rep. of Germany

[73] Assignee: Maschinenbau Oppenweiler GmbH, Oppenweiler, Fed. Rep. of Germany

[21] Appl. No.: 901,334

[22] Filed: May 1, 1978

[30] Foreign Application Priority Data

May 3, 1977 [DE] Fed. Rep. of Germany ..... 2719784

[51] Int. Cl.[2] ..... B65H 45/18

[52] U.S. Cl. ..... 270/83

[58] Field of Search ..... 270/62, 66, 67, 80–85

[56] References Cited

U.S. PATENT DOCUMENTS 1,305,129 5/1919 Lange ..... 270/86

FOREIGN PATENT DOCUMENTS 206870 11/1923 United Kingdom ..... 270/82

1080045 8/1967 United Kingdom ..... 270/67

*Primary Examiner*—Edgar S. Burr

*Assistant Examiner*—A. Heinz

*Attorney, Agent, or Firm*—Hopgood, Calimafde, Kalil, Blaustein & Lieberman

[57] ABSTRACT

The invention contemplates an improved folding machine for providing different types of folds. The machine includes a folding knife mechanism which is rotatably mounted in the machine frame about an axis of rotation which lies in the plane of the sheet to be folded so that at a first position the knife operates upwardly and at a second position the knife operates downwardly. These different directions of operation will produce different types of folds without the need of different folding mechanisms for each type of folds.

14 Claims, 6 Drawing Figures

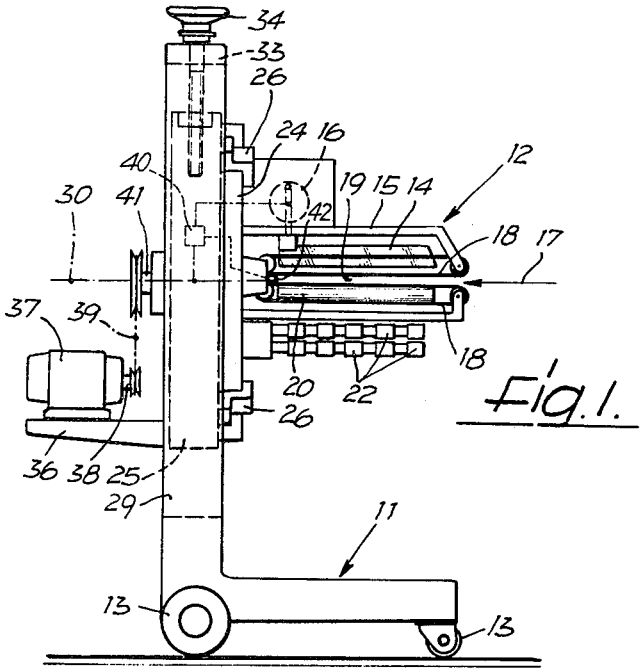
Fig. 1.
Fig. 2.
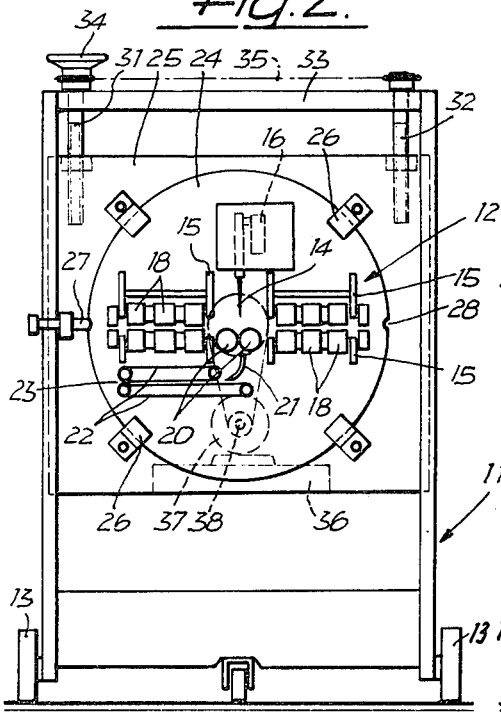
Fig. 3.
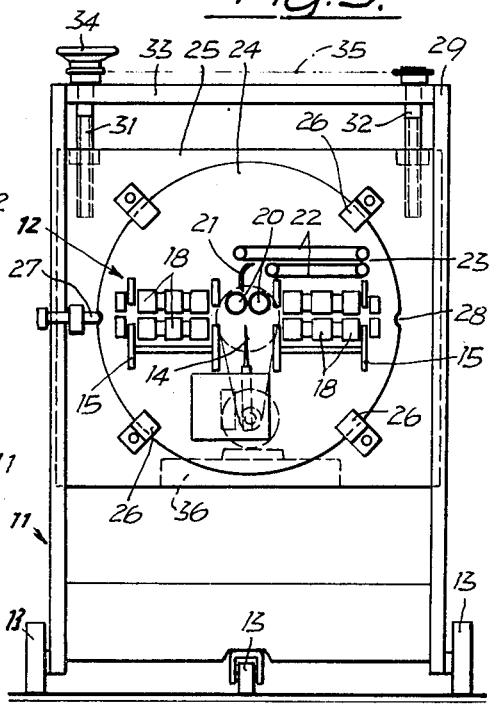

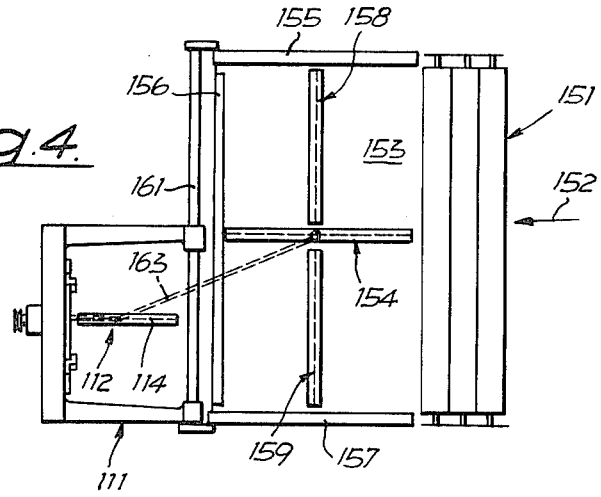
Fig.4.
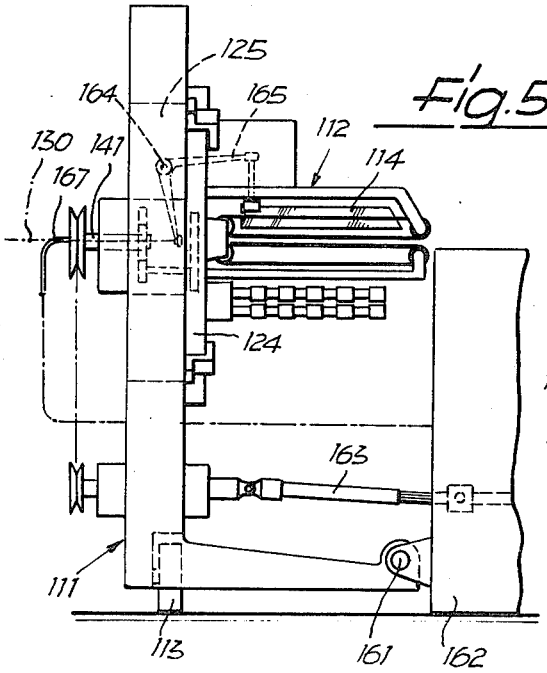
Fig.5.
Fig.6.
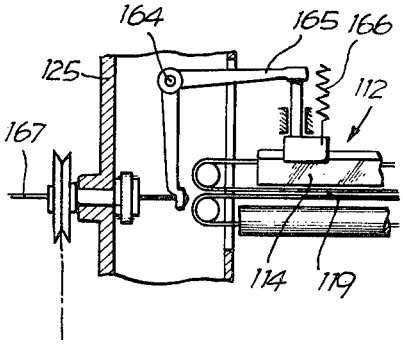

FOLDING MACHINE

The invention relates to a folding machine with a knife folding mechanism which has a folding knife that is mounted so it can be reciprocated in an essentially vertical direction, a conveyor mechanism that feeds a sheet introduced into the folding machine in a feeding direction to an essentially horizontal aligning plane, and a pair of folding rollers to which the sheet is fed from the aligning plane by the folding knife, in which a drive mechanism is provided for driving the folding knife, the conveyor mechanism and the folding rollers.

If a sheet, pre-folded at least twice, is introduced into a knife folding mechanism, then, depending upon whether the folding knife operates downwardly or upwardly various folds are achieved. A sheet which has been pre-folded twice, results in a 16 page newspaper or a 16 page right angle fold in the third folding depending of the direction of said third fold. A further folding of a sheet already folded three times into a 16 page right angle fold, depending on the direction of the fourth folding, results in the 32 page international or 32 page English fold. If pre-folded into a 16 page newspaper fold, the fourth fold results in the 32 page German or a less common 32 page fold.

A knife folding mechanism activated after at least two folding mechanisms can therefore carry out only one of several possible foldings. In DE-OS No. 17 61 377 a combined 32 page folding machine is shown in which the last folding mechanism, designed as a knife folding mechanism is developed as a separate mobile construction unit which can be positioned at a combined 16 page folding machine in four different positions, so that in this known, combined 32 page folding machine all four kinds of 32 page foldings can be carried out by a knife folding mechanism activated afterwards. However, the combined 16 page folding machine already requires two third folding mechanisms designed as knife folding mechanisms for producing a 16 page right angle fold or a 16 page newspaper fold. The principal disadvantage of this known combined 32 page folding machine lies in the fact that just for producing the three common folds, namely the international, the German and the English fold, the fourth folding mechanism must be mounted on three different sides of the combined 16 page folding machine, so that this known machine requires a floor space two and a half times as large as that of a common combined 32 page folding machine with an incorporated fourth folding mechanism.

In the combined 32 page folding machine shown in DE-AS No. 24 08 351, only two different 32 page foldings can be carried out, namely the international and the German folding. Just as with the aforementioned 32 page folding machine, two knife folding mechanisms are required for producing the 16 page folds, namely the newspaper and right angle folds, and for producing both 32 page folds, two further knife folding mechanisms are required. In this machine the fourth folding mechanism has a knife operating downward and another a knife operating upward.

It is the object of the invention to provide a folding machine with a knife folding mechanism in which, by means of the knife folding mechanism, a sheet which has already been folded at least twice in folding mechanisms can be provided with one of two different folds.

In a folding machine of the kind previously mentioned, this object is achieved according to the invention, by providing that the knife folding mechanism is rotatable on an axis lying in its alignment plane and parallel to the feeding direction. The knife folding mechanism is mounted in the machine frame and can be locked into two positions disposed opposite one another, in which the folding knife can be operated both upwardly and downwardly. If a sheet which has been pre-folded twice in the two preceding folding mechanisms is folded in the knife folding mechanism according to the invention, then a right angle or newspaper fold is obtained, depending on the position of the knife above or below the alignment plane.

In the case of a sheet pre-folded three times, in the folding machine according to invention, by pivoting the knife folding mechanism, one obtains the 32 page international or English fold from the 16 page right angle fold brochure, and the 32 page German or the less common 32 page fold from a 16 page newspaper fold brochure. The invention thus enables, with a single knife folding mechanism, the production of two different foldings of sheets pre-folded at least twice.

In an advantageous embodiment of the invention, the knife folding mechanism is fastened to a disk which is vertical to and coaxial with the swing axis of the knife folding mechanism. The disk is mounted in the machine frame, is rotatable on its axis, and can be locked in at least two positions. An especially simple construction of the folding machine according to the invention thus results.

In a further advantageous embodiment, the folding machine according to the invention can be developed as a mobile unit. It is also advantageous to connect the knife folding mechanism to the machine frame vertically adjustable so that it can be positioned at the exit of any other folding machine to form a further fold.

A drive mechanism which pivots with the knife folding mechanism can be provided for driving the knife folding mechanism. It is, however, more advantageous to provide a shaft mounted coaxially with the swing axis of the knife folding mechanism, the shaft is connected to a drive which, in the embodiment designed as a mobile unit, is attached to a frame which carries the rotatable knife folding mechanism and is vertically adjustable. It is thus possible to provide several folding mechanisms in the folding machine according to the invention and to provide these with a common drive which is fixed in the machine frame and is connected only to the shaft mounted coaxially with the swing axis of the knife folding mechanism.

The rotatable knife folding mechanism can, for example, form the fourth and last folding mechanism of a combined 32 page folding machine with a first buckle folding mechanism, a second knife-folding mechanism and two third knife folding mechanisms. In an advantageous development, the last folding mechanism can be mounted so that it can be shifted vertically with respect to its sheet feeding direction and be locked into two positions which lie in the sheet conveyor path behind both of the third folding mechanisms in the combined 32 page folding machine. The result is that all four different kinds of 32 page folds can be produced with a single fourth knife folding mechanism.

The invention also makes it possible to replace both of the third folding mechanisms in a combined 16 or 32 page folding machine by a single knife folding mechanism so that the possibility exists of constructing a 32 page folding machine for forming all four possible 32 page folds from one buckle folding mechanism and only three knife folding mechanisms activated successively, of which the last two are both rotatably mounted.

The invention is described in detail in the following description of the embodiments shown schematically simplified in the drawings:

FIG. 1 is a side view of a first embodiment of a folding machine designed as a mobile construction unit which has only one knife folding mechanism.

FIGS. 2 and 3 are views of the first embodiment seen in the feeding direction of the sheet, with folding knife operating downward or upward, respectively.

FIG. 4 is a sketched top view of a second embodiment which is designed as a combined 32 page folding machine.

FIG. 5 is a drawing, corresponding to FIG. 2, of the last folding mechanism of the second embodiment.

FIG. 6 is a vertical section which shows the connection of the drive of the folding knife of the last folding mechanism to the folding knifes of the preceding folding mechanisms of the second embodiment.

DESCRIPTION OF THE PREFERRED EMBODIMENTS

The embodiment shown in FIGS. 1 to 3 of a folding machine in accordance with the invention has a machine frame 11, in which a knife folding mechanism 12 is mounted and is transportable on wheels 13, so that the folding machine forms a mobile unit having a single folding mechanism 12.

Knife folding mechanism 12 has a folding knife 14 which is mounted in a frame 15 which is movable vertically upwardly and downwardly. A crank mechanism 16 is provided for the upward and downward movement of folding knife 14. A conveyor 18 is mounted in frame 15, conveyor 18 has conveyor belts positioned on both sides of the sheet to be folded which is preferably pre-folded at least twice and which can be fed into knife folding mechanism 12 in feeding direction 17, the distance between the conveyor belts being adjustable to suit the varying thickness of the sheets to be fed in. The space resulting from the distance between conveyor belts 18 define, together with alignment gibs (not shown in the drawing) an essentially horizontal alignment plane 19 for the sheet that is to be folded.

A pair of folding rollers 20 are coordinated with folding knife 14, folding rollers 20 define a folding gap in which the sheet in the alignment plane 19 is fed by knife 14. After passing through the folding gap, the folded sheet is fed along a curved guide 21 to a conveyor consisting of conveyor belts 22 which grasp the sheet on both sides, and convey the folded sheet to the exit 23 of folding mechanism 12.

Frame 15 which supports folding mechanism 12 is fastened to a vertical disk 24, which is rotatably mounted on its axis 30 in a frame 25. Disk 24 is mounted to frame 25, by means of four holding braces 26. A latch-bolt 27 is slidably mounted along its longitudinal axis on frame 25 for engagement with two grooves 28 lying diametrically opposite each other, to lock disk 24 in the positions shown in FIGS. 2 and 3, with folding knife 14 operating respectively downwardly and upwardly.

Frame 25 is vertically displaceable by means of a pair of facing rails 29 of machine frame 11 and frame 25 can be locked into position. Displacement and locking of frame 25 are provided by two threaded rods 31 and 32 rotatably mounted to a cross beam 33 joining the upper ends of rails 29. Threaded rod 31 mounts a handwheel 34 and is connected to threaded rod 32 by a chain drive 35. Threaded rods 31, 32 engage the edges of frames 25 adjacent to rails 29, so that these can be adjusted, without tilting, to the desired height by turning the hand wheel 34.

An electric motor 37 is fixed to a bracket 36 which is mounted to frame 25, the drive shaft 38 of electric motor 37 is connected by a V-belt drive mechanism 39 to a shaft 41, which is rotatably mounted to frame 25. Shaft 41 is coaxial to axis of rotation 30 of disk 24, and is connected to crank mechanism 16 and the conveyor belts 18 and 22 by corresponding drive mechanisms. Crank mechanism 16 for folding knife 14 is connected to shaft 41 by a clutch 40 such as a magnetic clutch with a brake, which performs one revolution for each cycle of folding knife 14. Folding knife 14 is activated when a feeler 42, such as a light barrier, indicates that a sheet is positioned in alignment plane 19.

Because of the vertical adjustability of the entire folding mechanism 12 by means of threaded rods 31 and 32, the folding machine can be positioned with the entrance of the conveyor belt 18 at the exit of any other type of folding machine. Furthermore, since knife folding mechanism 12 can be fixed in two positions 180° apart, through the rotatable mounting of disk 24, knife folding mechanism 12 can hereby be used with knife 14 operating both upwardly or downwardly as desired. The conveyor belt 18 is so arranged with respect to disk 24 that the axis of the alignment plane 19 is not altered by the rotation of knife folding mechanism 12 from one position to the other.

The above described embodiment of the folding machine may be used with e.g., a 16 page folding machine, to produce a sheet or brochure folded four times. A 16 page folding machine has, as a rule, two exits, one exit from which a newspaper fold brochure emerges and one exit from which a rig ht angle fold brochure emerges. Thus, the folding machine of the invention is enabled, by positioning at the appropriate exit of a 16 page folding machine and by the choice of the suitable position of knife folding mechanism 12, to fold kinds of 32 page brochures.

In the embodiments shown in FIGS. 4 to 6, those parts which corresponds to the parts of the first embodiment shown in FIGS. 1 to 3 are marked with reference numbers increased by 100.

The preferred second embodiment of a folding machine in accordance with the invention is shown in FIGS. 4 to 6, constructed as a combined 32 page folding machine which has a buckle folding mechanism 151 to which the sheets that are to be folded are fed in direction 152, and by a first folding are provided with a fold which is vertical with respect to direction 152. Thus folded, the sheet is conveyed by a conveyor mechanism (not shown) to the alignment plane 153 of a second folding mechanism 154 which is a knife folding mechanism. The alignment plane 153 is limited on three sides by three stop gibs 155, 156 and 157 which align the sheet. This second folding mechanism 154 is indicated in FIG. 4 by the top view of its folding knife, whose working edge is shown by a dotted line in order to express the fact that here it refers to a knife operating from the top downward, with its working edge is underneath. Below alignment plane 153 of second folding mechanism 154 a right third folding mechanism 158 and a left third folding mechanism 159 are positioned, which are also designed as knife folding mechanisms with their knifes operating from the top downward.

A fourth folding mechanism 112, also constructed as a knife folding mechanism, can be set as desired in the position shown in FIG. 4 behind left third folding mechanism 159 or in the position behind right third folding mechanism 158. For this purpose a frame 111 carrying fourth folding mechanism 112 is slidably mounted along a horizontal rod 161 which is fastened to a frame 162 carrying the buckle folding mechanism 151 and the second and both of the third folding mechanisms 154, 158 and 159. The outer side of frame 111 is mounted on a roller 113 which facilitates shifting frame 111 and fourth folding mechanism 112.

Fourth folding mechanism 112 is constructed and mounted in the frame 111 exactly like the folding mechanism 12 of the first embodiment shown in FIGS. 1 to 3, but with the difference that the frame 125 carrying the rotary disk 124 is not vertically adjustable and the shaft 141 is connected to the drive of the other folding mechanisms 151, 154, 158 and 159 by a telescopic universal shaft 163 and not by its own motor. A further difference is that no crank mechanism is provided for driving folding knife 114 but an angular lever 165 pivoting on an axis 164, mounted in the frame 125 is provided. Lever 165 is kept by a tension spring 166 in the position in which knife 114 is in the position shown in FIGS. 5 and 6, lifted above the alignment plane 119. One arm of angular lever 165 is connected to the drive of the folding knives of the other three knife folding mechanisms 154, 158 and 159 over a Bowden cable 167 guided through an axial hole by shaft 141.

A sheet fed to buckle folding mechanism 151 is folded by second folding mechanism 54 and left third folding mechanism 159 into a 16 page right angle fold brochure, which is folded into 32 page international fold brochure by fourth folding mechanism 112, if the knife folding mechanism is set so that folding knife 114 operated from the bottom upward. If knife folding mechanism 112 is turned 180°, so that the folding knife 114, as shown in FIG. 5, operated from the top downward, then an English-folded 32 page brochure results.

On the other hand, if the sheet folded by second folding mechanism 154 is fed to the right third folding mechanism 158, then a 16 page newspaper fold brochure is formed which is folded into a 32 page German fold brochure by the fourth folding mechanism 112, if it is set with folding knife 114 operating from the top downward. By turning the knife folding mechanism 112 on its axis 130, then the fourth 32 page brochure can also be formed.

The second embodiment of the folding machine permits all four possible 32 page foldings to be carried out, with only a single fourth knife folding mechanism, the fourth knife folding mechanism having to be movable to only two different positions behind the combined 16 page folding machine.

In another embodiment, not shown here, fourth folding mechanism 112 can also be positioned below the alignment planes of both third folding mechanisms 158 and 159, which provided a folding machine the same size dimensionally as the 32 page folding machines in which a separate fourth knife folding mechanism is required for each of the four kinds 32 page folds.

What is claimed is:

1. Folding machine having a machine frame and a knife folding mechanism for folding a sheet introduced in said folding machine, said knife folding mechanism comprising a folding knife, said folding knife being mounted for reciprocating movement in an essentially vertical direction, an essentially horizontal aligning plane for aligning the sheet to be folded with respect to said folding mechanism, a conveyor means for conveying a sheet introduced into said folding machine to said aligning plane in a feeding direction, a pair of folding rollers between which the sheet to be folded is introduced by said folding knife from said aligning plane, said knife folding mechanism being rotatably mounted in said machine frame about an axis of rotation which is located in said aligning plane and parallel to said feeding direction, said folding machine further comprising locking means for locking said folding mechanism in a selected one of at least two angular positions about said axis of rotation, and drive means for driving said folding knife, said conveyor means and said folding rollers.

2. Folding machine in accordance with claim 1, comprising a disc located vertically and coaxially to said axis of rotation, said disc carrying said knife folding mechanism and being rotatably mounted in said machine frame about said axis of rotation, said locking means being provided for locking said disc.

3. Folding machine in accordance with claim 2, comprising a frame for carrying said disk, said carrier frame being mounted, vertically adjustable, in said machine frame and carrying said drive means.

4. Folding machine in accordance with claim 1, characterized in that a shaft mounted coaxial to said axis of rotation is provided, said shaft connecting said drive to at least said conveyor means and said folding rollers.

5. Folding machine in accordance with claim 4, characterized in that a crank mechanism, a clutch and a feeler are provided for driving said folding knife, said crank mechanism being connected to said shaft over said clutch, said feeler being provided for switching on said clutch when said feeler indicates the presence of a sheet in the aligning plane.

6. Folding machine in accordance with claim 1, characterized in that it is designed as a mobile unit and that said knife folding mechanism is connected, vertically adjustable, to said machine frame.

7. Folding machine in accordance with claim 1, characterized in that said conveyor means has conveyor belts which grasp the sheet on both sides.

8. Folding machine in accordance with claim 1, comprising several folding mechanisms arranged in a succession for successively folding the sheet, at least one of said several folding mechanisms being designed as said knife folding mechanism.

9. Folding machine according to claim 8, characterized in that two of said several folding mechanisms are arranged behind a common preceding folding mechanism in said succession of folding mechanisms, and comprising guide means for guiding said knife folding mechanism between a first position behind one of said two folding mechanisms and a second position behind the other of said two folding mechanisms.

10. Folding machine according to claim 9, said succession of folding mechanisms forming a 32 page folding machine and comprising a first folding mechanism designed as a buckle folding mechanism and a second folding mechanism designed as a knife folding mechanism comprising a folding knife, said two folding mechanisms preceding said knife folding mechanism being third folding mechanisms in said succession and being designed as knife folding mechanisms comprising folding knives.

11. Folding machine according to claim 10, in which said knife folding mechanism comprises a pivotably mounted angular lever connected to said folding knife for moving the same and a Bowden cable, connecting said angular lever to said drive means, said Bowden cable being guided essentially coaxially to said axis of rotation during passage from said knife folding mechanism to said drive.

12. Folding machine according to claim 9, said knife folding mechanism comprising a shaft mounted coaxially to said axis of rotation, said shaft being connected to at least said conveyor means and said folding rollers, said drive means being provided for driving said folding mechanisms preceding said knife folding mechanism, a telescopic universal shaft connecting said coaxially mounted shaft to said drive means.

13. In a folding machine for a sheet of material having a machine frame, a folding knife mounted for reciprocation in an essentially vertical direction, conveyor means for feeding said sheets to an essentially horizontal alignment plane of said folding knife, roller means for folding said sheet after said sheet is fed from said alignment plane by said folding knife, drive means for driving said folding knife, said conveyor means and said roller means, the improvement wherein said folding knife includes means for rotatably indexing said folding knife about an index axis with respect to said frame, the axis of index rotation of said folding knife lying in said alignment plane and parallel to the direction of feed of said conveyor means, said folding knife being mounted at a radial offset from the axis of index rotation and oriented to reciprocate toward and back from said index axis, and index driving means for positioning said folding knife in one index position above said alignment plane and in another indexed position below said alignment plane.

14. The folding machine in accordance with claim 13, and index locking means to selectively retain one of said indexed positions during a reciprocative cycle of said folding knife.

* * * * *